US010697139B1

(12) United States Patent
Goodwin

(10) Patent No.: US 10,697,139 B1
(45) Date of Patent: Jun. 30, 2020

(54) ELECTRIC ROAD FLARE

(71) Applicant: Gary Goodwin, Las Vegas, NV (US)

(72) Inventor: Gary Goodwin, Las Vegas, NV (US)

( * ) Notice: Subject to any disclaimer, the term of this patent is extended or adjusted under 35 U.S.C. 154(b) by 0 days.

(21) Appl. No.: 16/503,561

(22) Filed: Jul. 4, 2019

(51) Int. Cl.
*E01F 9/688* (2016.01)
*F21L 2/00* (2006.01)
*F21Y 115/10* (2016.01)

(52) U.S. Cl.
CPC ..... *E01F 9/688* (2016.02); *F21L 2/00* (2013.01); *F21Y 2115/10* (2016.08)

(58) Field of Classification Search
CPC ... E01F 9/559; E01F 9/688; F21L 2/00; F21S 8/086; F21V 5/04; F21V 29/77; F21Y 2115/10; Y02B 20/72
USPC ..... 340/815.45
See application file for complete search history.

(56) References Cited

U.S. PATENT DOCUMENTS 5,103,383 A * 4/1992 Mayhew ..... B60Q 7/00 362/158
5,201,410 A * 4/1993 Takano ..... H01H 13/14 200/252
5,785,410 A * 7/1998 Branson, Sr. ..... E01F 9/559 362/153
6,309,332 B1 * 10/2001 Hao ..... A63B 24/00 374/208
7,088,222 B1 * 8/2006 Dueker ..... B60Q 7/00 340/321
9,739,467 B1 * 8/2017 Lehman ..... F21V 23/0414
2002/0015629 A1 * 2/2002 Ito ..... F16B 13/0808 411/340
2002/0180616 A1 * 12/2002 Laidman ..... B60Q 7/00 340/908.1
2005/0254246 A1 * 11/2005 Huang ..... F21V 15/01 362/362
2005/0265024 A1 * 12/2005 Luk ..... F21S 10/02 362/231
2006/0027592 A1 * 2/2006 Flamingo ..... E01F 9/688 221/103
2008/0303659 A1 * 12/2008 Weiss ..... G08B 5/36 340/540
2010/0165578 A1 * 7/2010 Kearns ..... H01L 23/40 361/719
2011/0043126 A1 * 2/2011 McDermott ..... H05B 45/00 315/291
2013/0258660 A1 * 10/2013 Kim ..... F21V 21/00 362/235
2015/0009666 A1 * 1/2015 Keng ..... F21V 23/005 362/235
2015/0055353 A1 * 2/2015 Hutchens ..... F16M 13/02 362/370

* cited by examiner

*Primary Examiner* — Stephen R Burgdorf
(74) *Attorney, Agent, or Firm* — Steven Rinehart

(57) ABSTRACT

An improved electric road flare assembly formed of a plurality of LED arrays, a concave tripodal housing, and a translucent or transparent lens operable to be deployed along a roadside at night and display a plurality of high-intensity colors in a plurality of display modes. The electric road flare may be configured to display any color light on the visible light spectrum.

10 Claims, 8 Drawing Sheets

ELECTRIC ROAD FLARE

FIELD OF THE INVENTION

This invention relates to road flares, and more particularly relates to an electric road flare for use along roadsides in dark conditions at night.

BACKGROUND

Description of the Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Police and emergency responders often must make use of road flares at night to direct traffic around accidents, injuries, crime scenes, hazards, and/or construction. Road flares serve as temporary warnings on a roadway to approaching vehicles. Ignitable, or combustible, road flares are commonly used by emergency personnel and commercial drivers for these purposes. These conventional ignition flares have many inefficiencies, however, including the extreme fire hazard they pose on roadsides to brush and debris; and even the clothing of law enforcement officers. Because they are often used in the presence of hazardous materials, such as petroleum spills, further hazards are obvious.

Ignitable flares have high burn rates and often last for only minutes before burning out, requiring new flares be ignited at additional expense, inconvenience and danger. Additionally, the ignitable flares themselves must be disposed of as hazardous waste after use, creating further expense and complications for law enforcement and other operators.

Accordingly, there remains a need for an electric road flare which is compact and portable and which serves the same purpose as ignitable road flares without the hazards. With improvements in battery life and LED luminosity, improvements to road flares are possible. Moreover, it is desirable that the road flare be safe environmentally, inexpensive, and easily operated.

With the foregoing in mind it is, therefore, a primary object of the present invention to provide a compact, portable electric road flare which meets all of the foregoing requirements. In view of the foregoing, it should be clear that there is a need in the industry for an electric road flare such as that described and taught herein below.

SUMMARY

From the foregoing discussion, it should be apparent that a need exists for an apparatus comprising an electric road flare. Beneficially, such an apparatus would provide a plurality of features and components efficacious for helping to cure the above-described deficiencies in the prior art, including extended operable life, expense, portability and the like.

The present invention has been developed in response to the present state of the art, and in particular, in response to the problems and needs in the art that have not yet been fully solved by currently available apparatus. Accordingly, the present invention has been developed to provide an electric road flare, the electric road flare comprising: a concave base member having a flaring annular flange, the concave base member defining a hollow interior recess with a planar floor, the concave base member having an open top end dimensioned to receive a PCB, the concave base member comprising: a cylindrical protuberance rising superiorly from the planar floor and defining an aperture through which a screw traverses; a PCB having three or more LED arrays of different colors, the PCB defining a centrally-disposed aperture through which the protuberance rises; a convex translucent lens positioning over the PCB, the convex translucent lens defining a centric bore for receiving a centric screw.

The base member may be circular. The annular flange may define a plurality of recesses sectioning the annular flange and forming feet. Each LED array may emit a light color of red, yellow, blue or white, in various embodiments.

In some embodiments, the base housing is tripodal. The PCB may be adapted to selectively activate the LED arrays in response to operator input such that the electric road flare emits any color on the visible light spectrum.

The electric road flare may further comprise one or more hooks forming a friction fit with the base housing adapted to suspend the base housing from an elevated structure.

The lens may comprise a plurality of elongated concentric projections rising superiorly adapted to reflect light.

The electric road flare may further comprise one or more of a wing nut, spacer, and second cylindrical protuberance rising from the planar floor.

In some embodiments, the screw comprises a shoulder screw.

The base housing, PCB, and lens may all be detachably connected using the shoulder screw without intervening components.

The concave base member may further comprise, in some embodiments: a plurality of elongate posts for stabilizing the PCB; and a plurality of arcuate members for supporting one or more batteries.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method.

Figure 1:
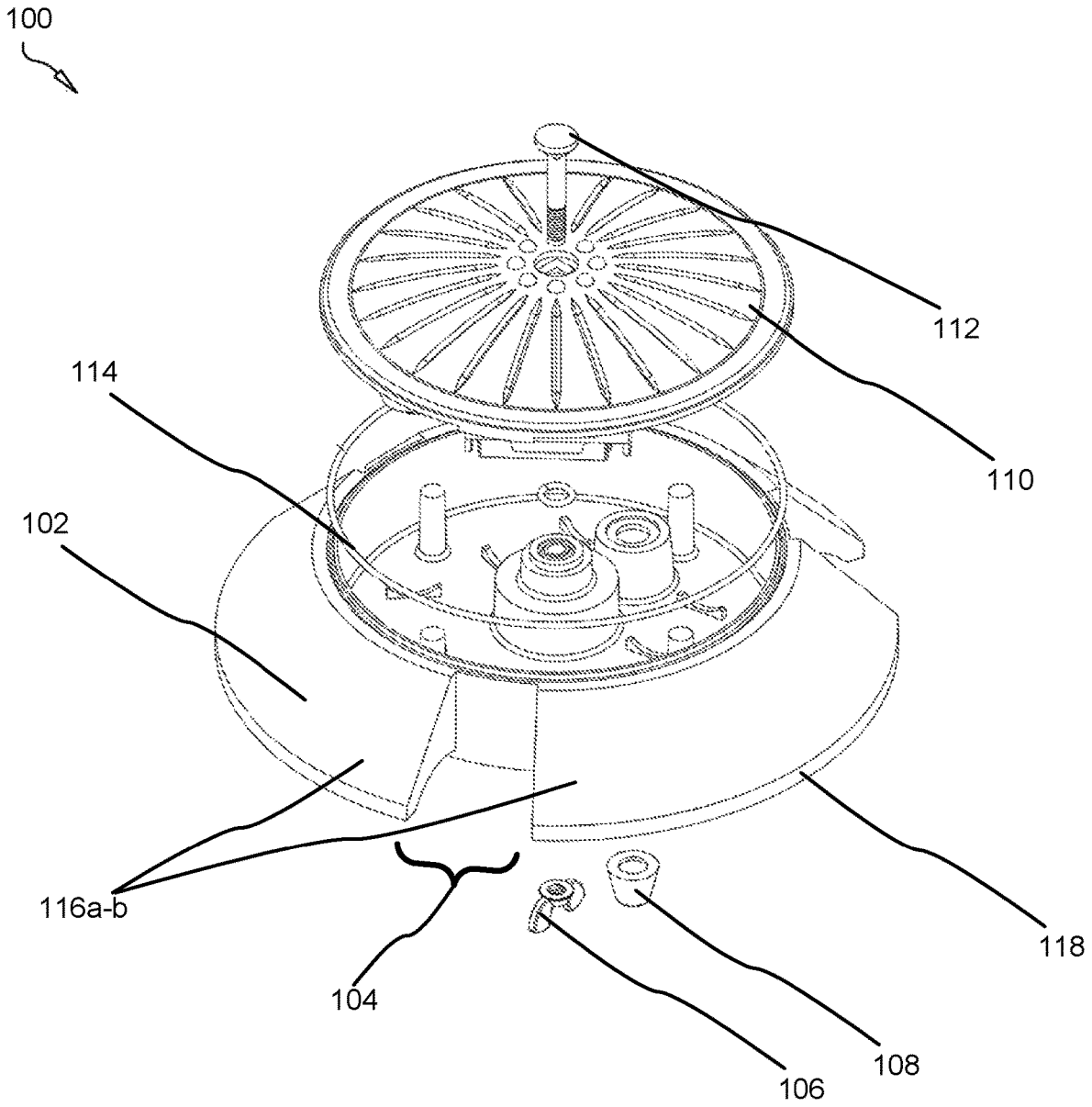
FIG. 1 is an isometric, side perspective view illustrating one embodiment of a disassembled electric road flare in accordance with the present invention.

FIG. 1 is an isometric, side perspective view illustrating one embodiment of a disassembled electric road flare 100 in accordance with the present invention.

The electric road flare 100 comprises a tripodal, concave base housing 102 which receives and houses the majority of the electric and/or electromechancial components which operate in connection with one another to impart effect to the apparatus 100.

The base housing 102 is tripodal, comprising three feet 116 in shown embodiment. In other embodiments, the base housing 102 may comprise no feet up through a large plurality of feet 116.

An annular flange 118 circumscribes the base housing 102 and is integrated as a single piece therewith in some embodiments. The annular flange 118 flares as it descends and defines a plurality of recesses 104 which section the annular flange 118 thus forming the feet 116. In various embodiments, the feet 116 protrude inferiorly from the centric level of the base member 102 such that the feet 116 engage a ground surface or sub grade.

The base member 102 may be circular as shown and formed from polymeric materials. Alternatively, the base member 102 may be square, triangular, polygonal, or otherwise shaped and/or formed from metal, metal alloy or organic materials (such as wood or leather).

The base member 102 positions inferiorly to the translucent prism-cut lens 110, which lens 110 positions over the open top end of the base member 102. In various embodiments, an O-ring 114 (i.e., washer or annular coupler) positions between the open top end of the base member 102 and translucent prism-cut lens 110.

The apparatus 100 further comprises a shoulder screw 112 which inserts into an aperture on the top of the translucent lens 110, traverses the apparatus 100 longitudinally, and affixes to a threaded wing nut 106 in various embodiments. The apparatus 100 may further comprise a washer 108 or separator.

Figure 2:
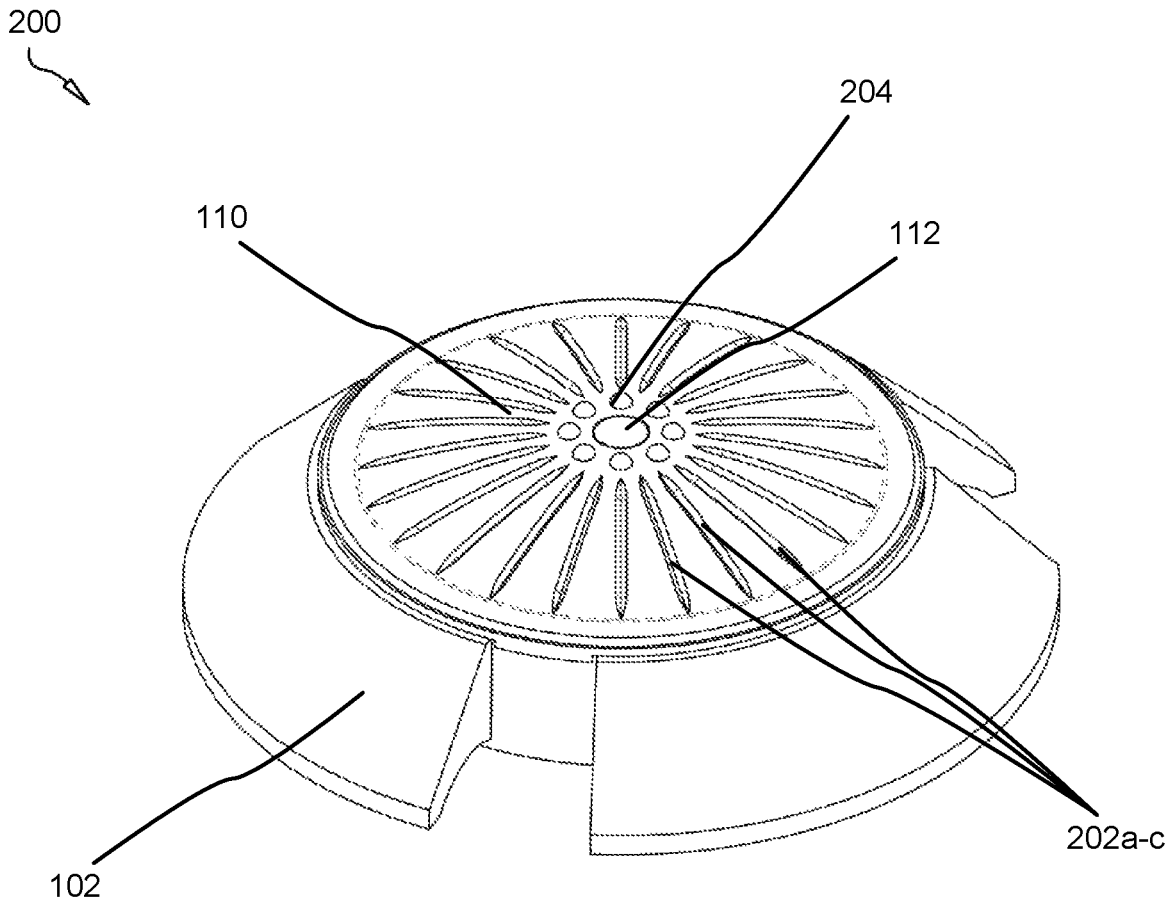
FIG. 2 is an isometric, side perspective view illustrating one embodiment of an assembled electric road flare in accordance with the present invention.

FIG. 2 is an isometric, side perspective view illustrating one embodiment of an assembled electric road flare 200 in accordance with the present invention.

The flare 200 comprises the translucent prism-cut lens 110 which itself comprises a plurality of concentric, superiorly-rising projections 202 which axially circumscribe the shoulder screw 112 as shown.

The projections 202 are adapted to bend light, disperse light, and add reflect light emanating from LED arrays within the base housing 102. In various embodiments, a plurality of hemispheres or semi-hemispheres position concentrically on the lens 110.

The translucent lens 110 may comprise a plurality of multi-colored translucent materials.

Figure 3:
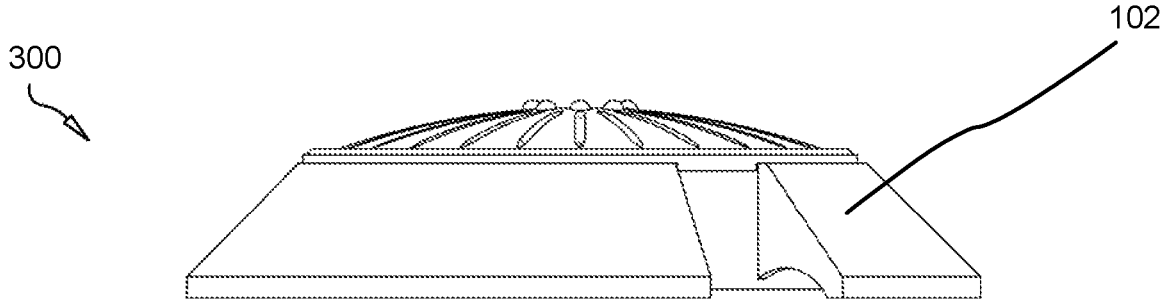
FIG. 3 is a side perspective view illustrating one embodiment of an electric road flare in accordance with the present invention.

FIG. 3 is a side perspective view illustrating one embodiment of an electric road flare 300 in accordance with the present invention.

The overall side profile of the apparatus 300 forms a dome shape.

Figure 4:
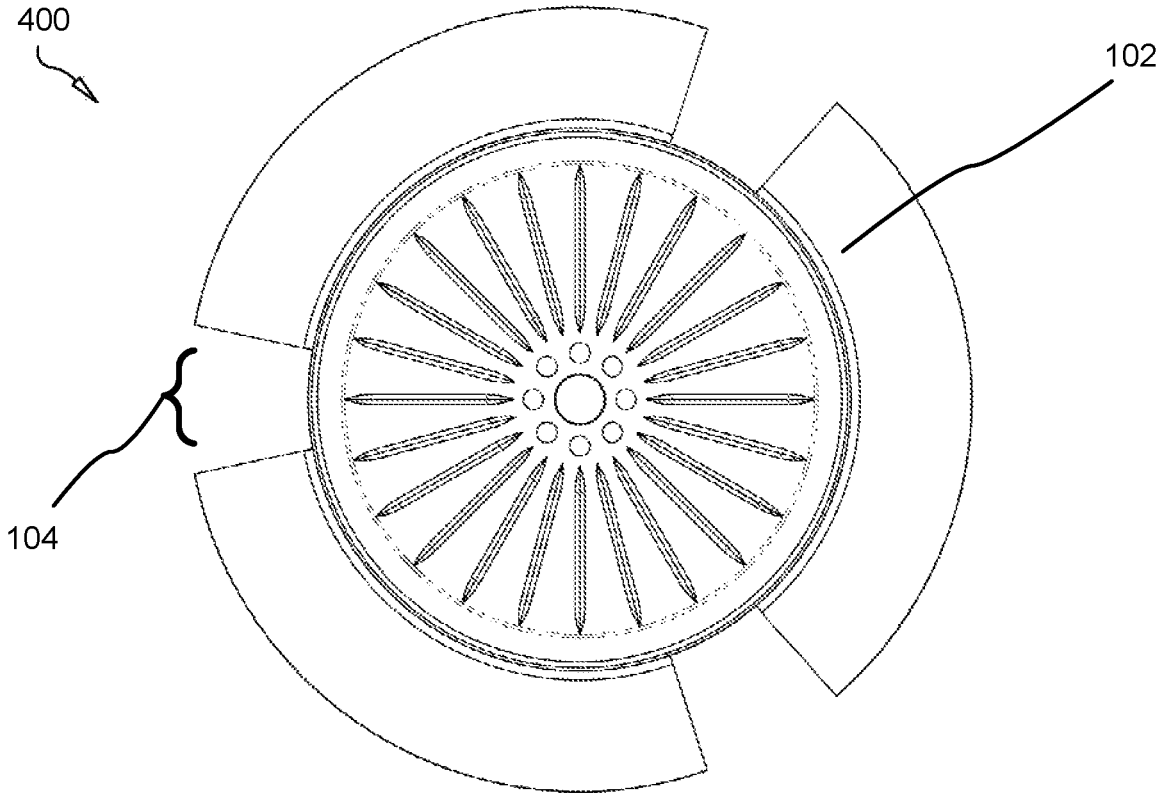
FIG. 4 is a top perspective view illustrating one embodiment of an electric road flare in accordance with the present invention.

FIG. 4 is a top perspective view illustrating one embodiment of an electric road flare 400 in accordance with the present invention.

The circular base member 102 comprises recesses 104 which are evenly spaced forming feet 116.

Figure 5:
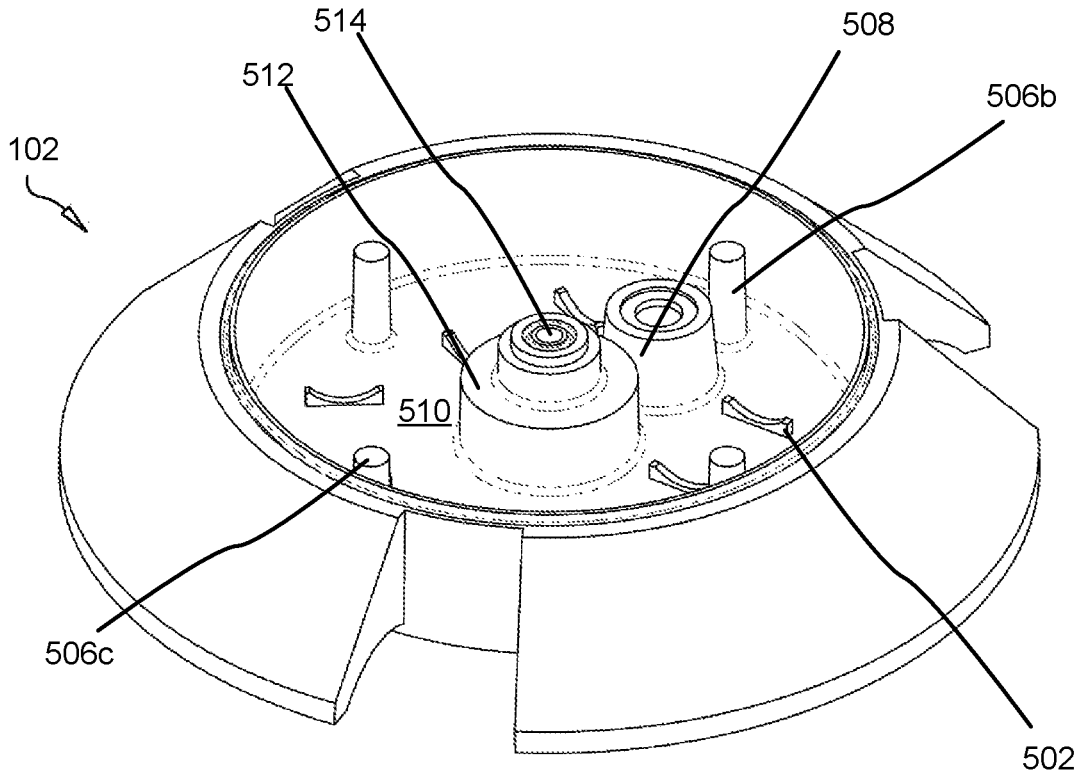
FIG. 5 is an isometric, top perspective view illustrating one embodiment of the housing of an electric road flare in accordance with the present invention.

FIG. 5 is an isometric, top perspective view illustrating one embodiment of the housing of an electric road flare 500 in accordance with the present invention.

The interior floor 510 of the base member 102 comprises a plurality of arcuate upwardly-protruding components 502 adapted to contour the exterior surface of a common battery (indicated at 1002 below). In the shown embodiment, the battery 1002 comprises a C battery, but comprise any battery known to those of skill in the art, including A, AA, AAA, D, and others. In various embodiments, the apparatus 500 additionally or alternatively comprises an AC or DC power supply which receives power from an external source, such as a vehicle vis-à-vis a cigarette lighter, battery terminals, or from a building using 110 V alternating current.

The floor 510 of the base member 102 may also comprise a plurality of posts 506 for supporting a printed circuit board (PCB) and/or the lens 110. These posts 506 may circumscribe the floor 510 at regular intervals or may be irregularly placed across the floor 510.

A first cylindrical protuberance 512 rises superiorly from the floor 510. This protuberance 512, in some embodiments, comprises a second tiered protuberance, and a third is various embodiments. The cylindrical protuberance 512 forms a bore 514 through which the shoulder screw 112 passes. The protuberance 510 may also define a hollow interior recess into which the wing nut 106 and/or washer/spacer 108 are received.

The floor 510 also comprises a second superiorly-rising cylindrical protuberance 508 which may house a switch 600 or power supply, or other components known to those of skill in the art.

Figure 6:
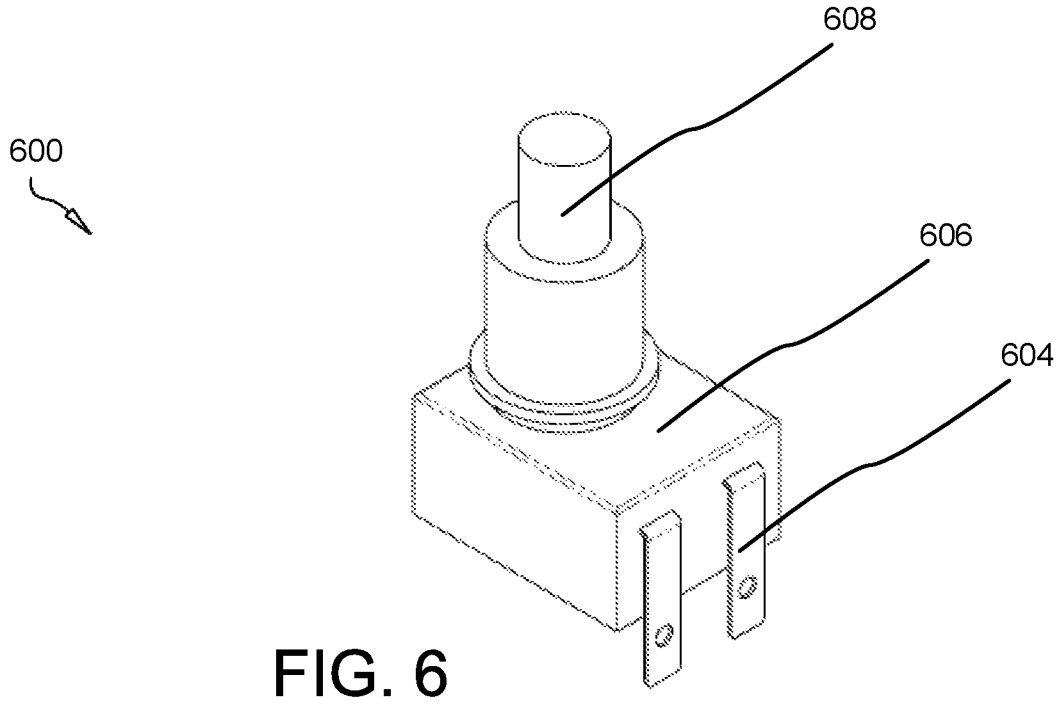
FIG. 6 is an isometric, top perspective view illustrating one embodiment of the switch of an electric road flare in accordance with the present invention.

FIG. 6 is an isometric, top perspective view illustrating one embodiment of the switch 600 of an electric road flare in accordance with the present invention.

The switch 600 comprises two electrical conductors 604 terminating at distal ends for receiving a DC power supply. The switch 600 comprises a housing 606 and depressible button 608 adapted to be activated tactilely as known to those of skill in the art.

Figure 7:
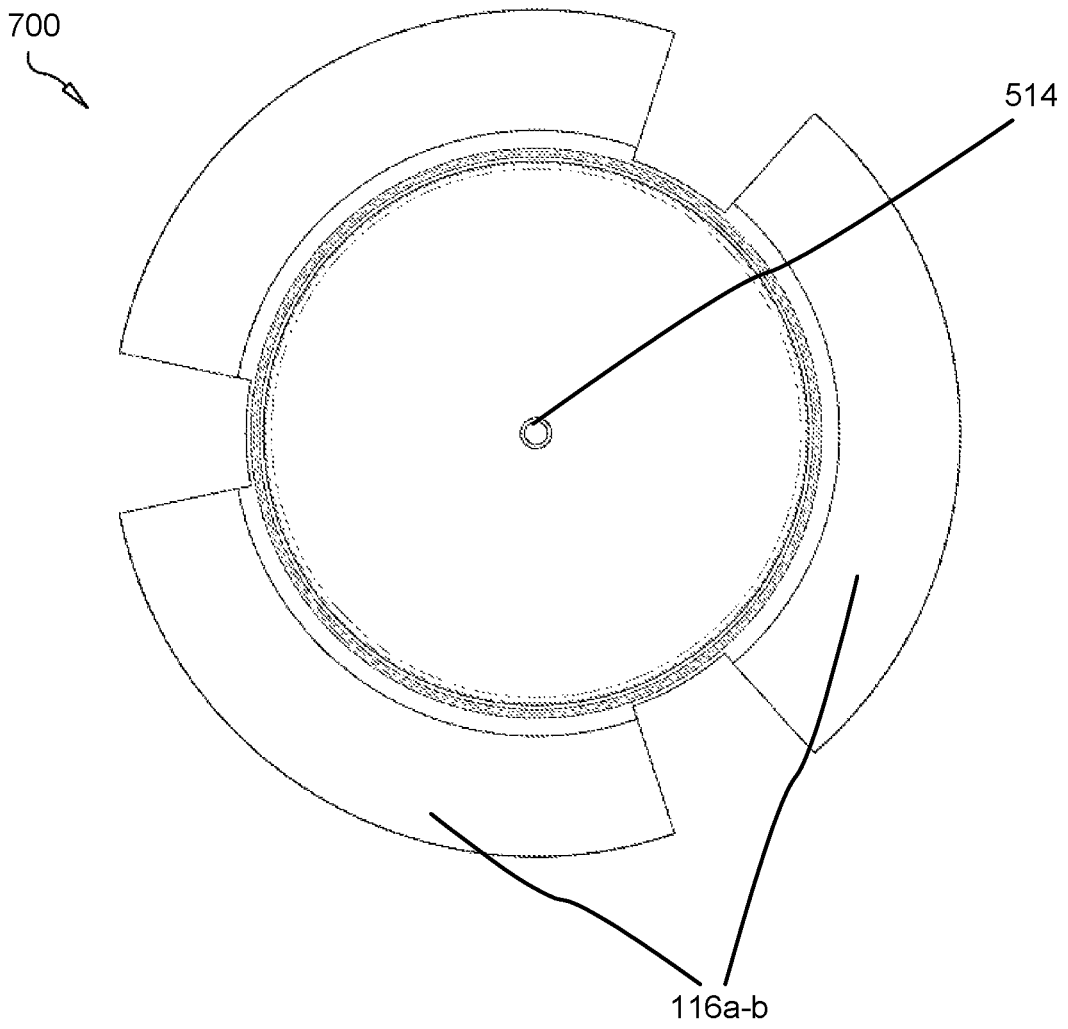
FIG. 7 is a bottom perspective view illustrating one embodiment of the housing of an electric road flare in accordance with the present invention.

FIG. 7 is a bottom perspective view illustrating one embodiment of the housing of an electric road flare 700 in accordance with the present invention.

In various embodiments, the feet 116 comprise wings extending laterally from the main body of the apparatus 700.

Figure 8:
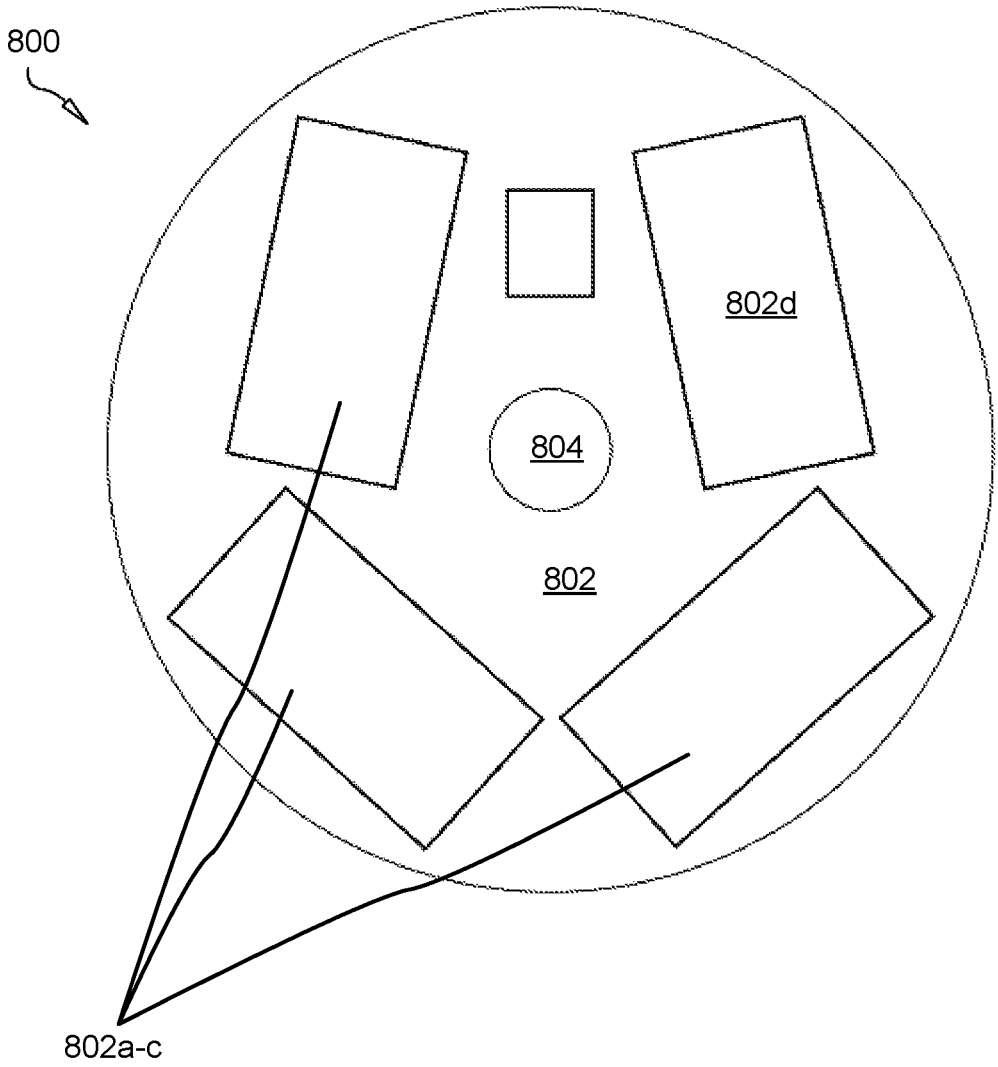
FIG. 8 is a top perspective view illustrating one embodiment of a printed circuit board of an electric road flare with LED arrays in accordance with the present invention.

FIG. 8 is a top perspective view illustrating one embodiment of a printed circuit board (PCB) 800 of an electric road flare with LED arrays in accordance with the present invention.

The PCB 800 comprises a plurality of LED arrays 802 spaced across the face 802 of the PCB 800. The LED array 802 are each activated by the PCB to operate in one of a plurality of modes. In various embodiments, these modes include flashing or steady lights, a plurality of colors, and the like. The PCB 800 uses surface mount technology to create a pallet of colors which may emanate from the apparatus 100, including RGB, RGBW, RGBWY and the like.

Depending on the amount of batteries 1002 used, the apparatus 100 may be configured to run continuously for 70 to 200 hours or more.

The shown embodiment, each of the four LED arrays emits one of the primary colors: red, yellow, blue (and white). The apparatus 100 is configurable to activate selectively one or more of the LED arrays 802 at different power settings. Using the primary colors, and blending them beneath the lens 110, the apparatus 100 may configured to emit light in any color on the visible color spectrum in accordance with user preferences.

The PCB 800 defines a bore, or aperture 804, through which the protuberance 512 protrudes.

The apparatus 100 may also, in some embodiments, include a speaker and may be adapted to receive and broadcast sound to surrounding listeners, and to receive information wirelessly with one or more separate DPDs (data processing devices) using Bluetooth® technology or other wireless technology. The apparatus 100 may comprise means for relaying and receiving electrical signals enabling device-to-device communication and may make use of the Bluetooth® protocols and procedures enabling DPD intercommunication connectivity. This functionality may be provided by incorporating the Bluetooth Intercom Profile® and/or the Bluetooth Telephony Profile®, or other wireless technologies known to those of skill in the art.

This communication may be in accordance with core specifications of one or more subsets of Bluetooth® profiles, wherein the core specifications comprise one or more of: the Cordless Telephony Profile (CTP), the Device ID Profile (DIP), the Dial-up Networking Profile (DUN), the File Transfer Profile (FTP), the Hands-Free Profile (HFP), the Human Interface Device Profile (HID), the Headset Profile (HSP), and the Intercom Profile (ICP), the Proximity Profile (PXP).

Multiple electric road flares 100 may be networked together and information including media exchanged between them wirelessly The apparatus 100 may further comprise a wireless receiver for interconnecting the apparatus wirelessly over a WAN (Wide Area Network) or LAN (Local Area Network).

Figure 9:
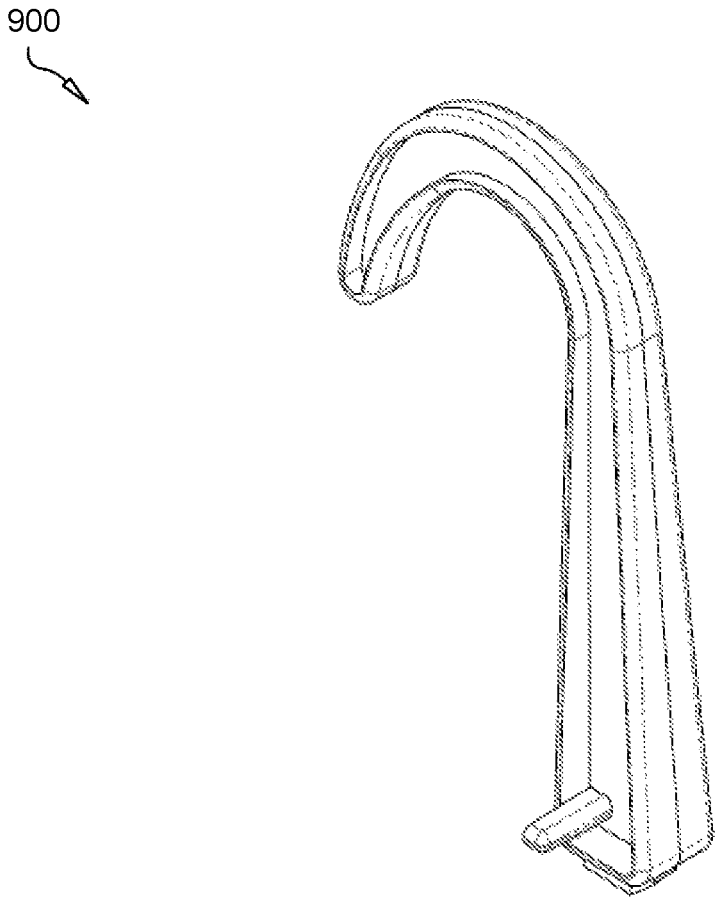
FIG. 9 is a top perspective view illustrating one embodiment of the housing of the hook of an electric road flare in accordance with the present invention.

FIG. 9 is a top perspective view illustrating one embodiment of the housing of the hook 900 of an electric road flare in accordance with the present invention.

The apparatus 100 may comprise one or more hooks 900 which affix using a friction fit to the base housing 102, allowing the apparatus 100 to be hung from fencing, vehicles, posts and the like.

Figure 10:
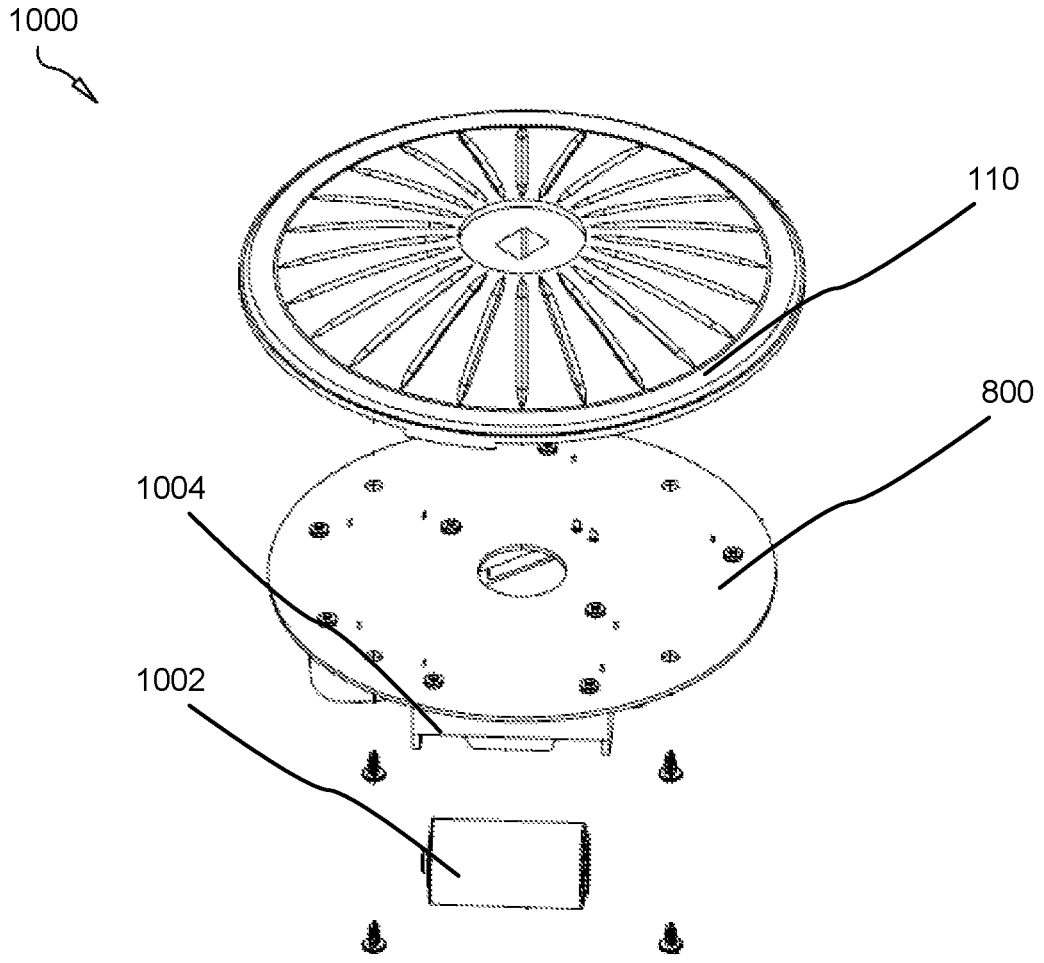
FIG. 10 is a top, side perspective view illustrating one embodiment of the lens and PCF of an electric road flare in accordance with the present invention.

FIG. 10 is a top, side perspective view illustrating one embodiment of the lens and PCF 1000 of an electric road flare in accordance with the present invention.

A "C" battery 1002 affixes into a bracket 1004 using friction fit as shown. The bracket 1004 is disposed inferiorly the PCB 800. The PCB 800 is received by the base housing 102 and the lens 100 disposes over the PCB 800 and base housing 102.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An electric road flare, the electric road flare comprising:

a concave base member having a flaring annular flange, the concave base member defining a hollow interior recess with a planar floor, the concave base member having an open top end dimensioned to receive a printed circuit board (PCB), the planar floor of the concave base member comprising:

a cylindrical protuberance rising superiorly from the planar floor and defining an aperture through which a shoulder screw traverses, the cylindrical protuberance comprising a second tiered protuberance;

a second superiorly-rising cylindrical protuberance comprising a switch having a depressible button;

a plurality of upwardly-protruding arcuate components adapted to contour an exterior surface of a common battery;

wherein the annular flange defines three or more evenly-spaced recesses forming three or more feet;

a PCB having three or more light emitting diodes (LED) arrays of different colors, the PCB defining a centrally-disposed aperture through which the protuberance rises, the PCB further comprising a bracket disposed inferiorly to the PCB adapted to receive a battery;

an O-ring positioning between the open top end of the base member and convex translucent lens;

the convex translucent lens positioning over the PCB and over the concave base member, the convex translucent lens defining a centric bore for receiving a centric screw;

wherein the base housing, PCB, and lens are all detachably connected using the shoulder screw without intervening components.

2. The electric road flare of claim 1, wherein the base member is circular.

3. The electric road flare of claim 1, wherein the feet protrude inferiorly from the centric level of the base member.

4. The electric road flare of claim 1, wherein each LED array emits a light color of red, yellow, blue or white.

5. The electric road flare of claim 1, wherein the base housing is tripodal.

6. The electric road flare of claim 1, wherein the PCB is adapted to selectively activate the LED arrays in response to operator input such that the electric road flare emits any color on the visible light spectrum.

7. The electric road flare of claim 1, further comprising one or more hooks forming a friction fit with the base housing adapted to suspend the base housing from an elevated structure.

8. The electric road flare of claim 1, wherein the lens comprises: (1) a plurality of elongated concentric projections rising superiorly adapted to reflect light; and (2) a plurality of hemispheres positioned concentrically.

9. The electric road flare of claim 1, further comprising one or more of a wing nut, spacer, and second cylindrical protuberance rising from the planar floor.

10. The electric road flare of claim 1, wherein the concave base member further comprises:

a plurality of elongate posts for stabilizing the PCB; and a plurality of arcuate members for supporting one or more batteries.

* * * * *